US008250780B1

(12) United States Patent
Diaz

(10) Patent No.: US 8,250,780 B1
(45) Date of Patent: Aug. 28, 2012

(54) SANDAL SYSTEM WITH INTERCHANGEABLE STRAPS

(76) Inventor: Eidys Diaz, Hialeah, FL (US)

( * ) Notice: Subject to any disclaimer, the term of this patent is extended or adjusted under 35 U.S.C. 154(b) by 319 days.

(21) Appl. No.: 12/762,717

(22) Filed: Apr. 19, 2010

(51) Int. Cl.
*A43B 3/24* (2006.01)
*A43B 3/12* (2006.01)

(52) U.S. Cl. ..... 36/11.5; 36/15; 36/101

(58) Field of Classification Search ..... 36/11.5, 36/100, 101, 15
See application file for complete search history.

(56) References Cited

U.S. PATENT DOCUMENTS

| | | | | | |
|---|---|---|---|---|---|
| 2,368,314 | A | * | 1/1945 | Marx | 36/11.5 |
| 2,526,940 | A | * | 10/1950 | Fello | 36/11.5 |
| 4,297,798 | A | * | 11/1981 | Colan | 36/101 |
| 4,450,633 | A | * | 5/1984 | Connelly | 36/101 |
| 4,461,102 | A | * | 7/1984 | DeVincentis | 36/101 |
| 4,887,369 | A | * | 12/1989 | Bailey et al. | 36/101 |
| D384,494 | S | | 10/1997 | Clancy | |
| 5,992,058 | A | | 11/1999 | Jneid | |
| 6,349,486 | B1 | | 2/2002 | Lin | |
| 6,543,157 | B2 | | 4/2003 | Pan | |
| 6,651,359 | B1 | | 11/2003 | Bricker | |
| 7,168,189 | B2 | * | 1/2007 | Phelan | 36/101 |
| 7,222,441 | B2 | | 5/2007 | Smith et al. | |
| 7,272,899 | B1 | * | 9/2007 | Marak | 36/101 |
| 7,328,528 | B2 | | 2/2008 | Caminiti | |
| 7,584,555 | B2 | * | 9/2009 | Pearce | 36/101 |
| 2003/0233772 | A1 | * | 12/2003 | Musial | 36/100 |
| 2004/0187346 | A1 | * | 9/2004 | Bianchi et al. | 36/11.5 |
| 2005/0097781 | A1 | * | 5/2005 | Greene | 36/101 |
| 2006/0242861 | A1 | | 11/2006 | Dushey | |
| 2006/0248753 | A1 | | 11/2006 | Welsh | |
| 2010/0024251 | A1 | * | 2/2010 | Delgatty | 36/101 |
| 2010/0037486 | A1 | * | 2/2010 | Verheijen | 36/101 |
| 2010/0223812 | A1 | * | 9/2010 | Batanero Bastida | 36/100 |

* cited by examiner

*Primary Examiner* — Marie Patterson

(57) ABSTRACT

A sandal system kit comprising a base, wherein a slot is disposed in the base at a front edge and a track is disposed along edges of the base; a plurality of S-clips each having a first end configured to snugly hook into the track and a second end extending outwardly from the base; and a plurality of straps, wherein each strap can be secured to the base via the S-clips, via the slot, and via a first attachment means, wherein each strap can be secured in a variety of patterns according to the user's wishes; wherein a user can construct a variety of different sandals by interchanging the straps and attaching the straps to the base in various patterns.

19 Claims, 5 Drawing Sheets

SANDAL SYSTEM WITH INTERCHANGEABLE STRAPS

FIELD OF THE INVENTION

The present invention is directed to shoes and sandals, more particularly to a sandal system with interchangeable straps.

BACKGROUND OF THE INVENTION

It can be very expensive to purchase enough shoes for suiting all of one's outfits. In addition, individuals may have limited space for storing many pairs of shoes. The present invention features a sandal system with interchangeable straps. The sandal system of the present invention allows a user to have multiple styles of sandals by attaching desired straps to a base (e.g., a sole).

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Referring now to FIGS. 1-8, the present invention features a sandal system 100. The sandal system 100 of the present invention provides a means of constructing a variety of different types of sandals (e.g., colors, styles, etc.) from one standard base. Without wishing to limit the present invention to any theory or mechanism, it is believed that the sandal system 100 of the present invention is advantageous because it adds to the versatility of a sandal.

Figure 1:
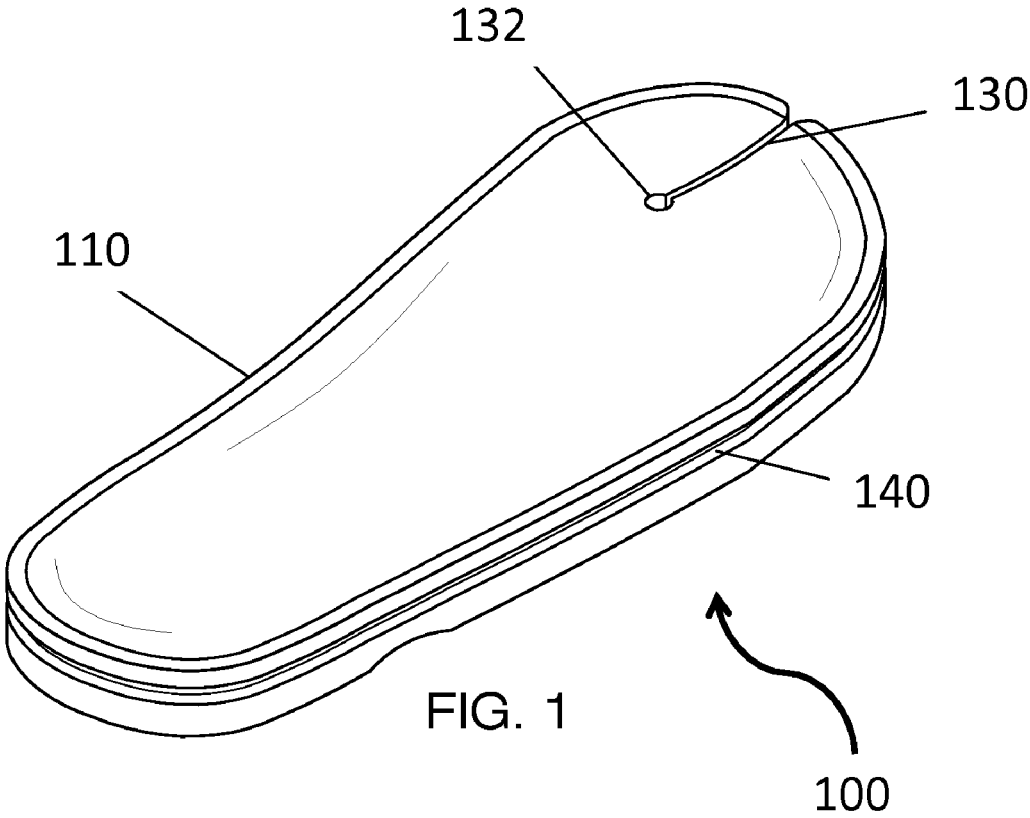
FIG. 1 is a perspective view of the sandal system of the present invention.
Figure 2:
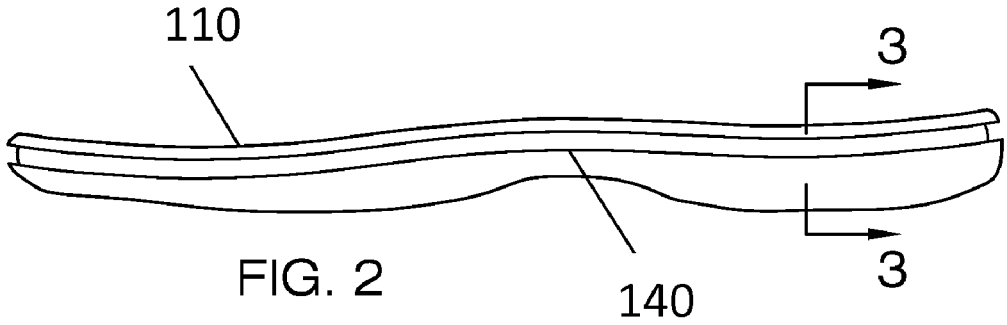
FIG. 2 is a side view of the sandal system of FIG. 1.
Figure 7:
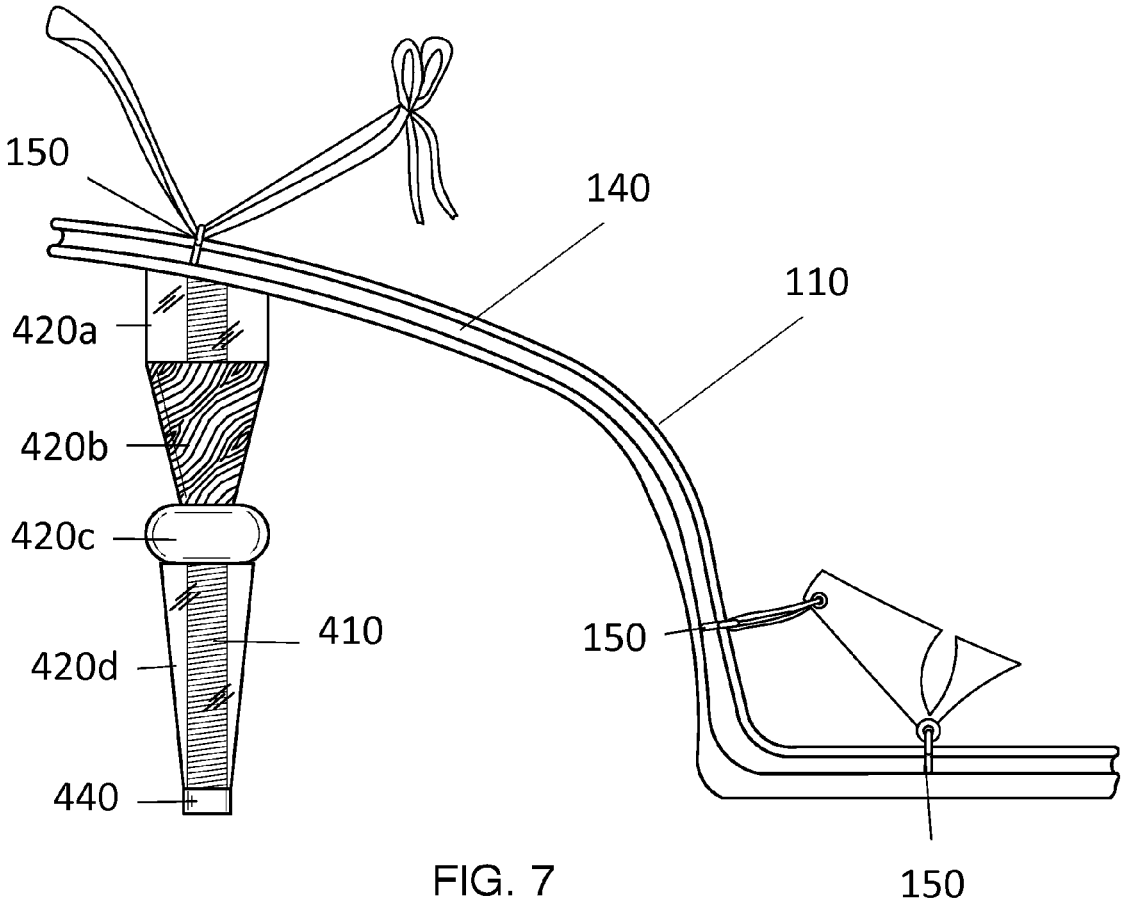
FIG. 7 is a side view of a sandal system of the present invention.
Figure 8:
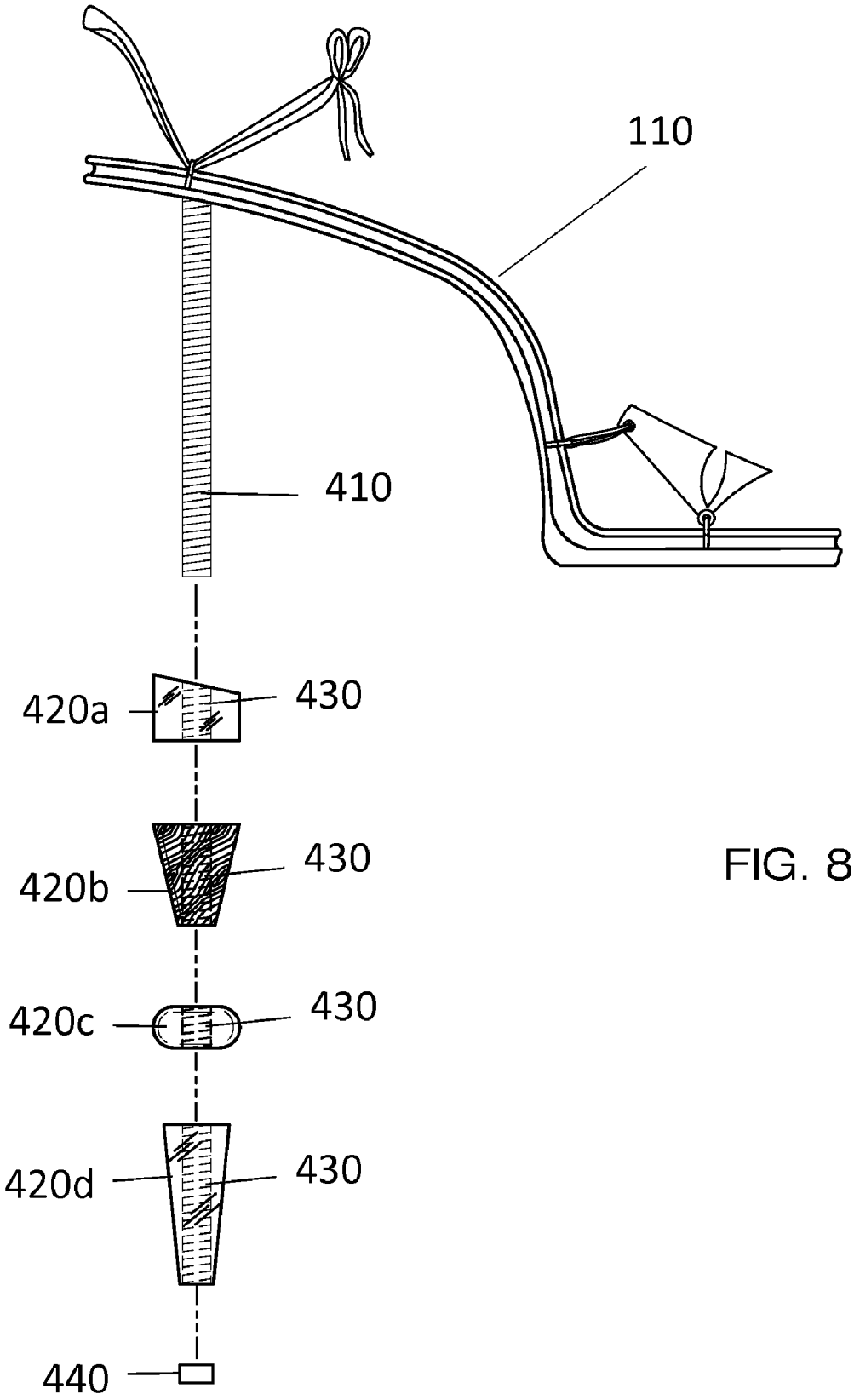
FIG. 8 is an exploded view of the sandal system of FIG. 7.

The sandal system 100 of the present invention comprises a base 110, which is similar to a sole of a standard sandal. Sandals and soles of sandals are well known to one of ordinary skill in the art. For example, the base 110 is generally elongated having a first side edge, a second side edge, a front edge, a back edge, a top surface, and a bottom surface. As shown in FIG. 1 and FIG. 2, the base 110 may be generally flat. As shown in FIG. 7 and FIG. 8, the base 110 may be curved to form a heeled shoe.

In some embodiments, a slot 130 is disposed in the base 110, for example a first end of the slot 130 is disposed at the front edge of the base 110. The second end 132 of the slot 130 may extend a certain distance into the base 110 (e.g., in the direction of the back edge of the base 110). In some embodiments, the slot 130 is between about 0.5 to 1.0 inches in length as measured from the first end to the second end 132. In some embodiments, the slot 130 is between about 1 to 2 inches in length as measured from the first end to the second end 132. In some embodiments, the slot 130 is between about 2 to 3 inches in length as measured from the first end to the second end 132. In some embodiments, the slot 130 is more than about 3 inches in length. In some embodiments, the second end 132 of the slot 130 is shaped like a hole (e.g., circular, cylindrical).

The base 110 may be constructed from a variety of materials, for example from a material comprising rubber, leather, wood, plastic, the like, or a combination thereof. The base 110 may be constructed in a variety of sizes, colors, and styles. For example, in some embodiments the base 110 is constructed in the form of a wedge shoe, a flat shoe, a platform shoe, and a heel (e.g., stiletto) (see FIG. 7, FIG. 8).

Figure 3:
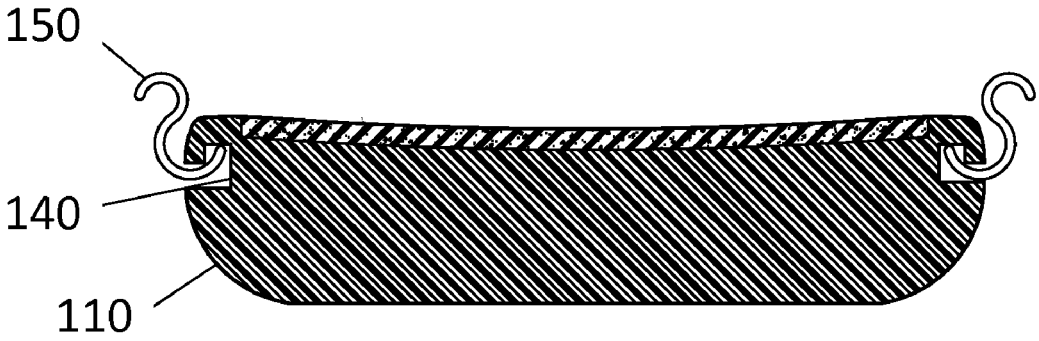
FIG. 3 is a cross sectional view of the sandal system of FIG. 1.
Figure 4:
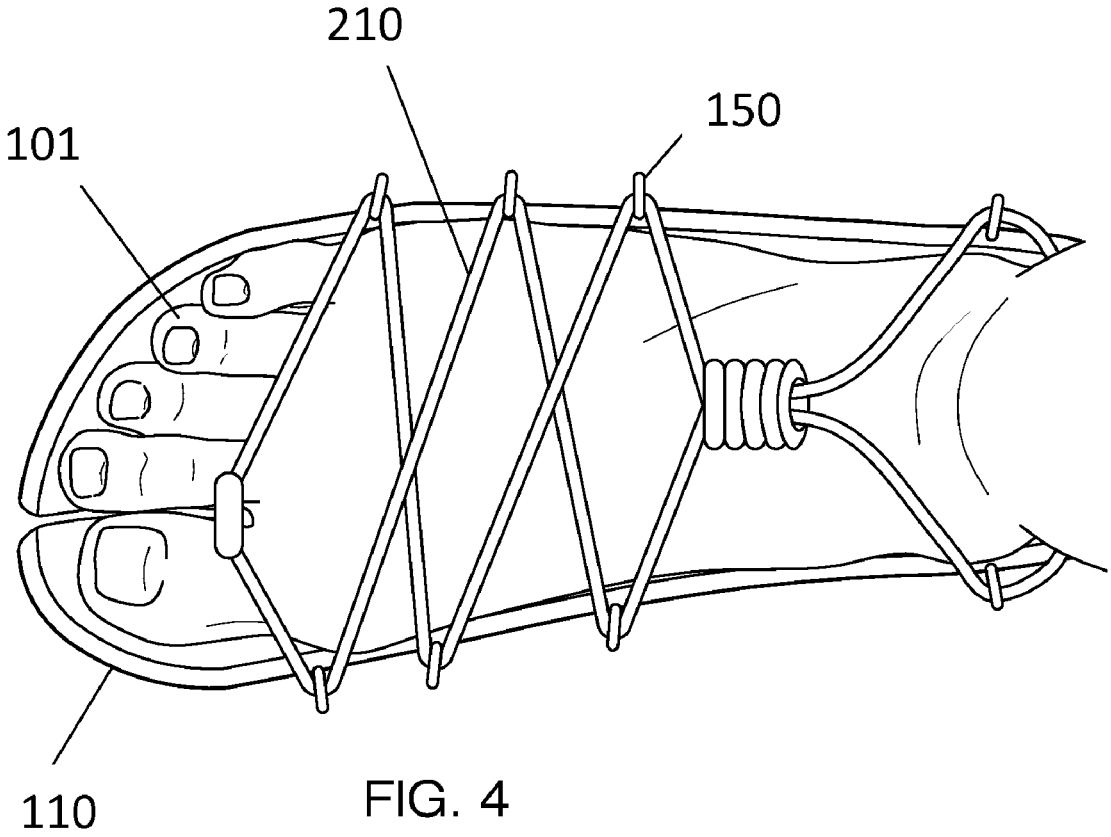
FIG. 4 is a top view of a sandal system of the present invention in use.
Figure 5:
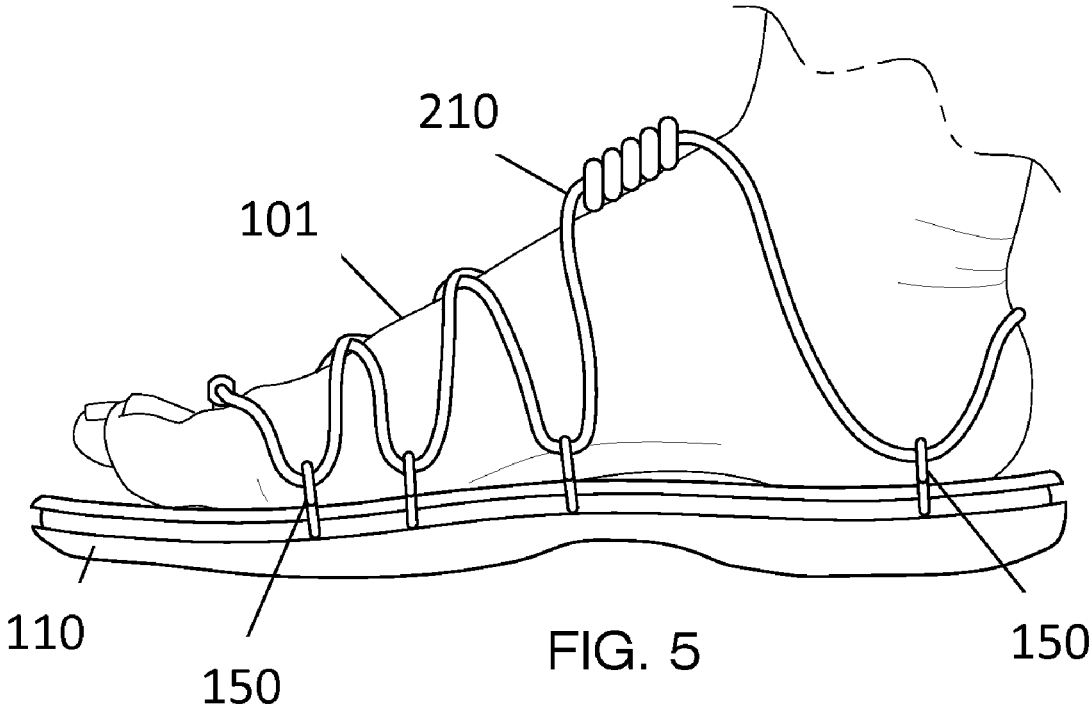
FIG. 5 is a side view of the sandal system of FIG. 4 in use.

Disposed along the edges of the base 110 (or portions of the edges of the base 110), for example the first side edge, the second side edge, the front edge, and/or the back edge, is a track 140. The track 140 is adapted to receive one or more S-clips 150 (see FIG. 3). As shown in FIG. 3, a first end of the S-clip 150 hooks into the track 140. The second end of the S-clip 150 extends outwardly from the base 110.

The sandal system 100 of the present invention further comprises one or more interchangeable straps 210. The straps 210 may be constructed from a variety of materials. In some embodiments, the straps 210 are constructed from a material comprising leather, plastic, nylon, rubber, cotton, suede, the like, or a combination thereof.

Each strap 210 has a first end and a second end. In some embodiments, the first end of the strap 210 is attachable to the base 110 via a first attachment means (e.g., clip mechanism, hook mechanism, clasp mechanism). In some embodiments, the second end of the strap 210 is attachable to the base 110 via a second attachment means (e.g., clip mechanism, hook mechanism, clasp mechanism). In some embodiments, the strap 210 may be secured (e.g., hooked into) in other locations, for example in the slot 130 or in the S-clips 150 in the track 140. The strap 210 can be connected to the base 110 in any way that the user wishes. In some embodiments, the strap 210 rests across the front portion of the base 110, over or across the foot 101 of the user, behind the user's ankle, etc.

A user can construct a variety of different sandals by interchanging different straps and decorative pieces 610 (e.g., beads, chains, decorations such as flowers, triangles, etc.). This allows user to have numerous pairs of shoes (e.g., sandals).

Referring now to FIG. 7 and FIG. 8, in some embodiments, a heel shaft 410 (e.g., threaded screw) is disposed on (or attachable to) the bottom surface of the base 110. The heel shaft 410 functions to hold various decorative heel components 420, for example decorative heel components 420 can be threaded onto the heel shaft 410. Each decorative heel component 420 has a threaded channel 430 disposed therein for receiving the shaft 410. A heel lock 440 may be threaded onto the outer end of the heel shaft 410 for securing the decorative heel components 420 on the shaft 410.

The decorative heel components 420 may be constructed from a variety of materials including but not limited to wood, plastic (e.g., beads), metal, the like, or a combination thereof. The decorative heel components 420 may be constructed in a variety of shapes, for example triangular, circular (e.g., spherical), rectangular, the like, or a combination thereof. As shown in FIG. 7, the decorative heel components 420 include a generally square transparent piece **420*a*, a wooden triangular piece 420***b*, a plastic bead 420*c*, and a transparent rectangular piece 420*d*. The shaft 410 may be constructed in a variety of sizes for creating high or low heels.

In some embodiments, the sandal system 100 of the present invention is a kit comprising a base 110 and a plurality of interchangeable straps 210 (e.g., differently decorated straps). In some embodiments, the kit comprises between 2 and 5 interchangeable straps. In some embodiments, the kit comprises between 5 and 10 interchangeable straps. In some embodiments, the kit comprises more than 10 interchangeable straps.

Figure 6:
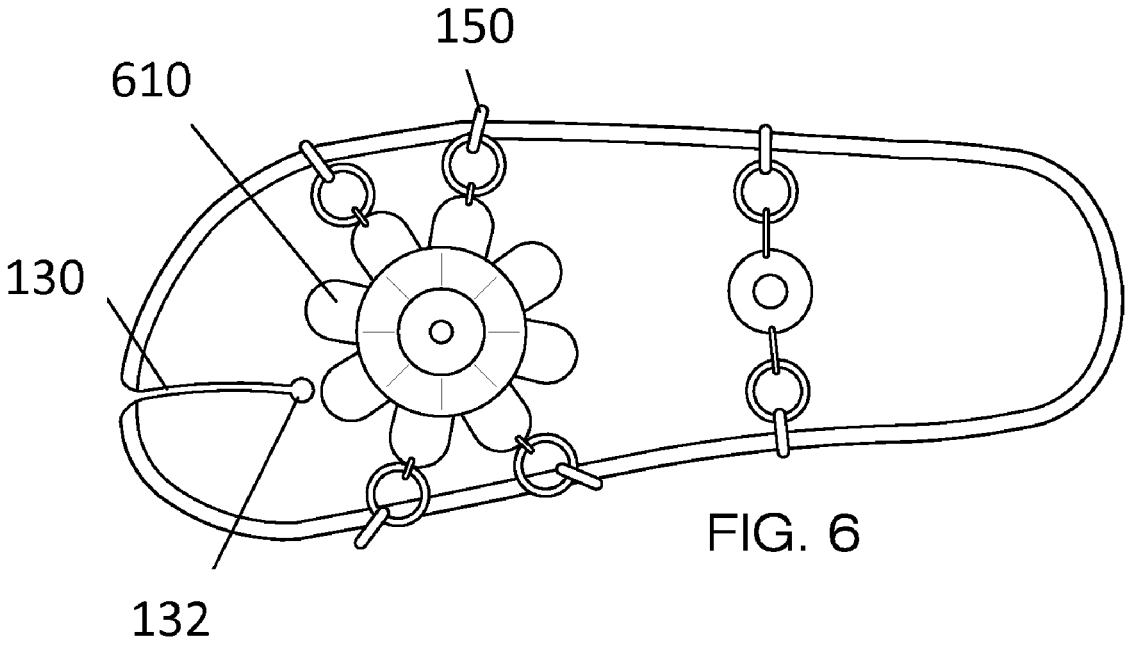
FIG. 6 is a top view of a sandal system of the present invention.

In some embodiments, the kit further comprises one or more decorative pieces 610. For example, as shown in FIG. 6, the decorative piece 610 may be for enhancing the appearance of the sandal or the decorative piece 610 may function like the strap 210. In some embodiments, decorative pieces 610 are attached to one or more straps 210.

In some embodiments, the kit further comprises a heel shaft 410 and/or a heel lock 440. In some embodiments, the kit further comprises a plurality of decorative heel components 420.

The following the disclosures of the following U.S. patents are incorporated in their entirety by reference herein: U.S. Pat. No. 7,222,441; U.S. Pat. Application No. 2006/0248753; U.S. Pat. Application No. 2006/0242861; U.S. Pat. No. 6,349,486; U.S. Pat. No. 6,543,157; U.S. Pat. No. 4,461,102; U.S. Pat. No. 6,651,359; U.S. Pat. No. 5,992,058; U.S. Pat. No. 7,328,528.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A sandal system kit comprising:

(a) a base, wherein a slot is disposed in the base at a front edge, wherein a track is disposed along each of a first side edge, a second side edge, the front edge, and a back edge of the base;

(b) a plurality of S-clips, each S-clip having a first end configured to snugly hook into the track and a second end extending outwardly from the base; and (c) a plurality of straps, wherein each strap can be secured to the base via the S-clips, via the slot, and via a first attachment means, wherein each strap can be secured in a variety of patterns according to the user's wishes;

wherein a user can construct a variety of different sandals by interchanging the straps and attaching the straps to the base in various patterns.

2. The sandal system kit of claim 1, wherein the base is generally flat.

3. The sandal system kit of claim 1, wherein the base is constructed to resemble a wedge shoe, a flat shoe, a platform shoe, or a heeled shoe.

4. The sandal system kit of claim 1, wherein the slot is between about 0.5 to 3 inches in length as measured from a first end to a second end.

5. The sandal system kit of claim 1, wherein the first attachment means includes a clip mechanism, a hook mechanism, or a clasp mechanism.

6. The sandal system kit of claim 1 further comprising a plurality of decorative pieces.

7. The sandal system of claim 1, wherein the decorative pieces can be attached to a strap.

8. The sandal system of claim 1, wherein the decorative pieces can be attached to the base.

9. The sandal system of claim 1, wherein a heel shaft is disposed on the base.

10. The sandal system of claim 9, wherein the kit further comprises a plurality of decorative heel components adapted to be threaded onto the heel shaft.

11. The sandal system of claim 10, wherein each decorative heel component has a threaded channel disposed therein for receiving the shaft.

12. The sandal system of claim 9, wherein the kit further comprises a heel lock adapted to thread onto an outer end of the heel shaft, the heel lock functions to secure decorative heel components on the shaft.

13. A sandal system kit comprising:

(a) a base, wherein a slot is disposed in the base at a front edge, wherein a track is disposed along each of a first side edge, a second side edge, the front edge, and a back edge of the base;

(b) a plurality of S-clips, each S-clip having a first end configured to snugly hook into the track and a second end extending outwardly from the base;

(c) a plurality of straps, wherein each strap can be secured to the base via the S-clips, via the slot, and via a first attachment means, wherein each strap can be secured in a variety of patterns according to the user's wishes;

(d) a heel shaft is disposed on the base, and a plurality of decorative heel components adapted to be threaded onto the heel shaft; and (e) a heel lock adapted to thread onto an outer end of the heel shaft, the heel lock functions to secure decorative heel components on the shaft;

wherein a user can construct a variety of different sandals by interchanging the straps and attaching the straps to the base in various patterns.

14. The sandal system kit of claim 13, wherein the slot is between about 0.5 to 3 inches in length as measured from a first end to a second end.

15. The sandal system kit of claim 13, wherein the first attachment means includes a clip mechanism, a hook mechanism, or a clasp mechanism.

16. The sandal system kit of claim 13 further comprising a plurality of decorative pieces.

17. The sandal system of claim 13, wherein the decorative pieces can be attached to a strap.

18. The sandal system of claim 13, wherein the decorative pieces can be attached to the base.

19. The sandal system of claim 10, wherein each decorative heel component has a threaded channel disposed therein for receiving the shaft.

* * * * *